US005203724A

United States Patent [19]

Casey

[11] Patent Number: 5,203,724

[45] Date of Patent: Apr. 20, 1993

[54] FIREWALL TERMINAL BLOCK

[75] Inventor: Daniel T. Casey, Harrisburg, Pa.

[73] Assignee: AMP Incorporated, Harrisburg, Pa.

[21] Appl. No.: 788,323

[22] Filed: Nov. 5, 1991

[51] Int. Cl.[5] ..... H01R 11/03; H01R 13/52

[52] U.S. Cl. ..... 439/792; 439/521; 439/709; 439/718; 439/860

[58] Field of Search ..... 439/521, 522, 790–792, 439/796, 797, 709, 718, 805, 810, 860

[56] References Cited

U.S. PATENT DOCUMENTS

| | | | |
|---|---|---|---|
| 2,984,817 | 5/1961 | Zeffert | 439/718 |
| 4,210,379 | 7/1980 | Vachhani et al. | 339/101 |
| 4,345,806 | 8/1982 | McHenney | 439/709 |
| 4,410,226 | 10/1983 | Adduci et al. | 439/521 |
| 4,795,380 | 1/1989 | Frantz | 439/860 |
| 4,845,589 | 7/1989 | Weidler et al. | 361/342 |
| 4,983,133 | 1/1991 | Van Scyoc et al. | 439/860 |

FOREIGN PATENT DOCUMENTS

| | | | |
|---|---|---|---|
| 2428332 | 2/1980 | France | 439/718 |

OTHER PUBLICATIONS

Reid Tool Catalog, "T-Bolts", pp. 49–50, Reid Tool Supply Co. Philadelphia, Pa.

*Primary Examiner*—Paula A. Bradley
*Attorney, Agent, or Firm*—Anton P. Ness

[57] ABSTRACT

An electrical connector (10) enabling interconnection of terminals (84,86) of pairs of power cables (80,82) in a high temperature environment includes a body member (12) having a plurality of connection sites (18) separated by barrier walls (66), a plurality of terminal bolts (20) secured to the body member with threaded shanks (26) extending from enlarged bolt heads (28) through apertures thereof and outwardly between the barrier walls to receive ring sections (88,90) of the terminals thereonto, and clamping members (22) threadable onto the threaded shanks to clamp the terminals against the termination face (76) of the body member and tightly against each other. A top cover (14) is securable over the terminations and completes surrounding leading ends of the threaded shanks with dielectric material between connection sites. A bottom cover (16) holds the enlarged bolt heads in respective recesses. Each terminal bolt (20) includes an annular compression surface (32) about flush with the termination face of the body member against which the ring sections of the terminals can be compressed under torque of about fourteen foot-pounds.

10 Claims, 3 Drawing Sheets

FIREWALL TERMINAL BLOCK

FIELD OF THE INVENTION

This relates to the field of electrical connectors and more particularly to terminal blocks for interconnecting a pair of power conductors.

BACKGROUND OF THE INVENTION

Certain environments through which electrical power cables must traverse are subjected to very high temperatures, such as adjacent engines of jet aircraft where temperatures may reach up to 550° F. Conventionally, such power cables transmit a current of up to 360 amperes at 115 volts, and have been continuous from the generator adjacent the engine located in each wing, for example, to a wall of the fuselage remote from the engine; in such arrangements, the entire cable length must be replaced when repair is needed, necessitating the tedious unfastening of the cable from holders closely spaced along its length.

It is desired to provide an arrangement whereby instead of use of a continuous cable, a pair of cable lengths is utilized having terminals on adjacent ends to be interconnected proximate the generator.

It is desired to provide an electrical connector or terminal block providing for an electrical interconnection of the terminals which is disconnectable if desired. It is known in general to provide a post onto which terminals having ring-shaped contact sections both are placed and pressed together to define a compression fit suitable to define an assured electrical connection therebetween for transmitting power levels of current along the cable pair.

It is desired to provide such an electrical connector which is adapted for high temperature environments and is also adapted to provide for the substantial levels of compression of such ring-shaped contact sections together.

SUMMARY OF THE INVENTION

The terminal block of the present invention comprises a body member of dielectric material of very high temperature resistance, onto which are mounted an array of terminal posts onto each of which is to be placed a pair of terminals having ring-shaped contact sections or the like, to be compressed together by a nut assembly torqued tightly onto the post, compressing the two ring-shaped contact sections downwardly toward the transverse section of the body member through which the threaded shank of each post extends along a respective aperture; the cables extend from the terminals outwardly of opposite sides of the body member. The post is adapted to support the terminals from substantial compression against the body member surface by a support flange or annular ledge approximately flush with the upper surface of the transverse section of the body member. The post heads along the bottom surface of the transverse section are disposed entirely in respective recesses in communication with a common longitudinal slot in which a dielectric cover is disposed, electrically insulating the post heads. The recesses are asymmetrically shaped to cooperate with asymmetric cross-sectional shapes of the post heads, preventing rotation thereof and facilitating torquing of each nut assembly onto a post shank, without the need of a tool gripping the post head from below, in turn allowing the connector to be mounted along its bottom surface to a bulkhead prior to connection of the terminals and permitting disconnection thereof. A top cover is mountable to the top of the connector, and barrier walls isolate the respective connection sites.

It is an objective of the present invention to provide a connector mountable to a bulkhead and thereafter permitting connection and disconnection of a pair of cable terminals at a respective connection site therealong.

It is another objective to provide such a connector which is adapted for use in high temperature environments.

It is also an objective to provide such a connector which is adapted for high compression of two terminals to a common terminal post in a manner which protects the housing from such high compression.

An embodiment of the present invention will now be described by way of example with reference to the accompanying drawings.

DETAILED DESCRIPTION OF THE PREFERRED EMBODIMENT

Figure 1:
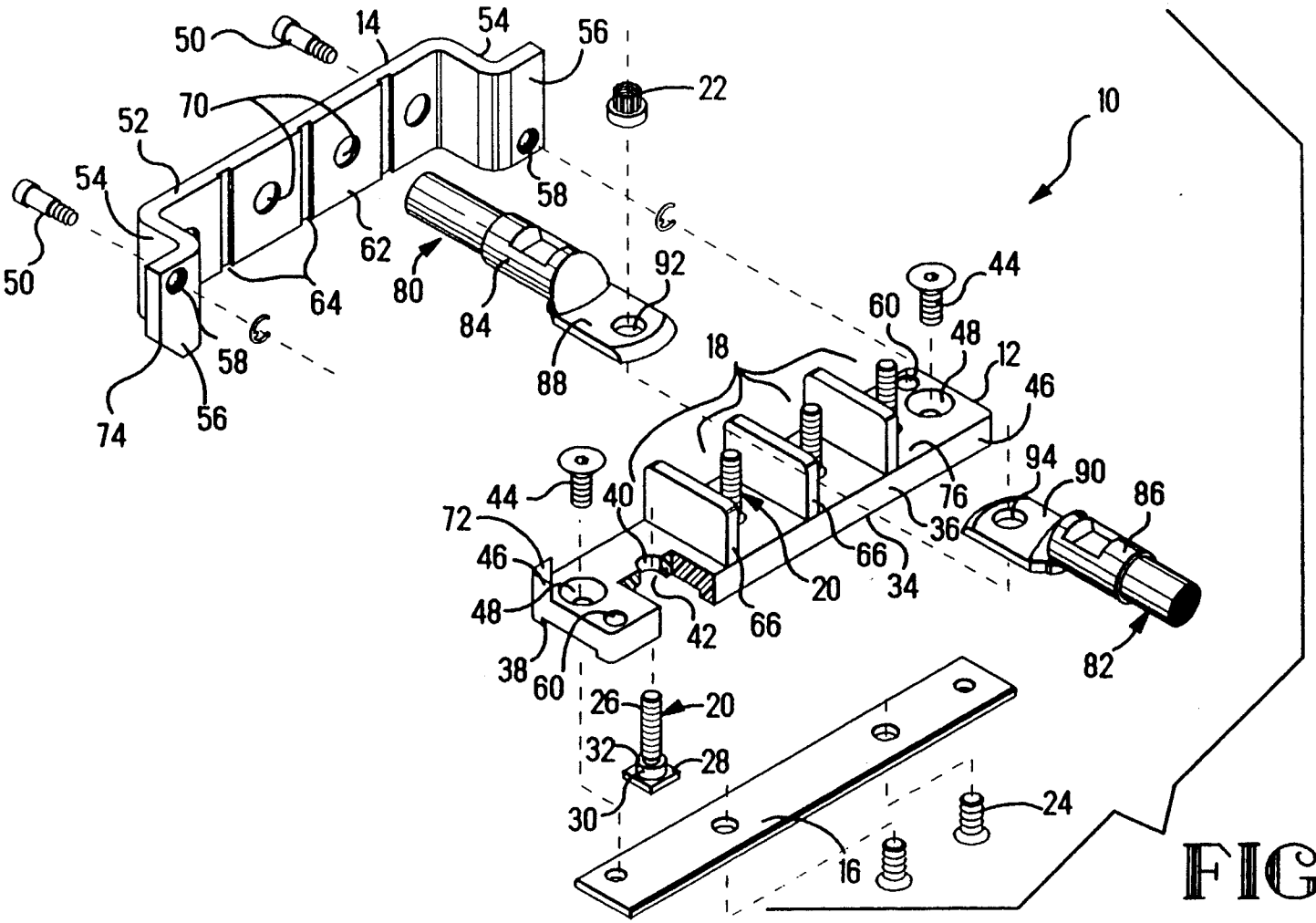
FIG. 1 is an exploded isometric view of the connector of the present invention, with a terminal post and corresponding nut assembly to which a pair of terminal cable ends are to be mounted.

The connector 10 includes a body member 12, a top cover 14, and a post head cover 16, and defines a plurality of connection sites 18, and further includes a like plurality of terminal posts 20 and associated nut assemblies 22 mountable to the connector at respective connection sites 18. A pair of cables 80,82 have crimped to ends thereof respective terminals 84,86 having ring-shaped contact sections 88,90 thereon. Each ring-shaped contact section has an aperture 92,94 therethrough adapted to receive therethrough a threaded shank 26 of a respective terminal post 20.

Each terminal post 20 includes a head 28 which has an asymmetric cross-section, such as being square, and further includes a large diameter shank portion 30 adjacent the head defining an annular compression surface 32. The diameter of the threaded shank 26 is such as to be received through apertures 92,94 of contact sections 88,90, while the diameter of large diameter shank portion 30 is larger than the diameter of apertures 92,94.

Bottom surface 34 of transverse section 36 of body member 12 includes a slot 38 therealong into which post head cover 16 is received upon assembly of connector 10. At each connection site 18, post-receiving holes 40 receive large diameter post shank portions 30 thereinto; a recess 42 (shown in a cutaway portion of FIG. 1) is shaped to just receive thereinto asymmetric head 28 of the post so that side walls of recess 42 prevent post head 28 from rotation without tool means as a nut assembly 22 is being threaded onto threaded shank 26. Upon assembly, post head cover 16 maintains the posts secured in connector 10 and is fastened in slot 38 by a pair of flathead screws 24. Connector 10 is mountable to a bulkhead such as by fasteners 44 extending through apertures 48 in end flanges 46 of transverse section 36.

Top cover 14 is fastened to connector 10 by fasteners 50 in a manner permitting connector 10 to remain mounted to the bulkhead. Top cover 14 includes a transverse cover section 52 between opposed vertical sections 54 and includes mounting ears 56 extending outwardly from vertical sections 54 to including mounting holes 58 for fasteners 50 aligned with corresponding mounting holes 60 of body member 12. Bottom surface 62 of transverse cover section 52 includes grooves 64 thereacross corresponding to barrier wall sections 66 of body member 12 which define and separate connection sites 18 for insulation of the respective terminals 84,86 and terminal posts 20, with grooves 64 adapted to receive leading edges or upper ends 68 of barrier wall sections 66 thereinto; such a complete dielectric material barrier between connection sites 18 greatly minimizes any potential arcing between connection sites during power transmission. Bottom surface 62 also includes circular recesses 70 thereinto adapted to receive leading ends of terminal post threaded shanks 26 thereinto. For polarization, body member 12 includes an embossment 72 at one of the corners of transverse section 36 corresponding to a cutout 74 in a corner of top cover 14, permitting assembly of top cover 14 in only one orientation and assuring that recesses 70 and grooves 64 are accurately located for proper assembly should top cover 14 and body member 12 not be symmetrical.

Figure 2:
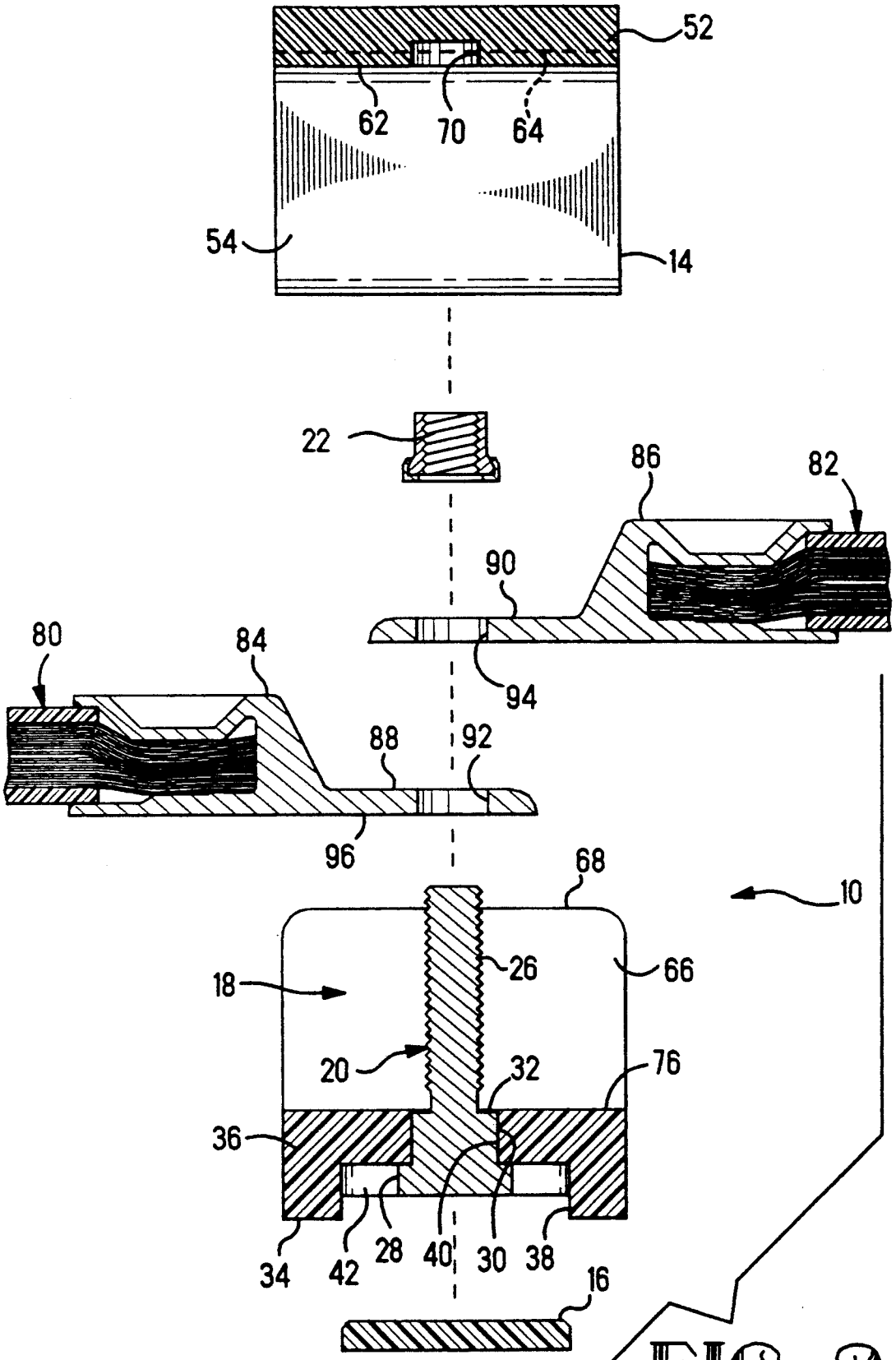
FIGS. 2 and 3 are cross-sectional views showing a termination site exploded and assembled, respectively.
Figure 3:
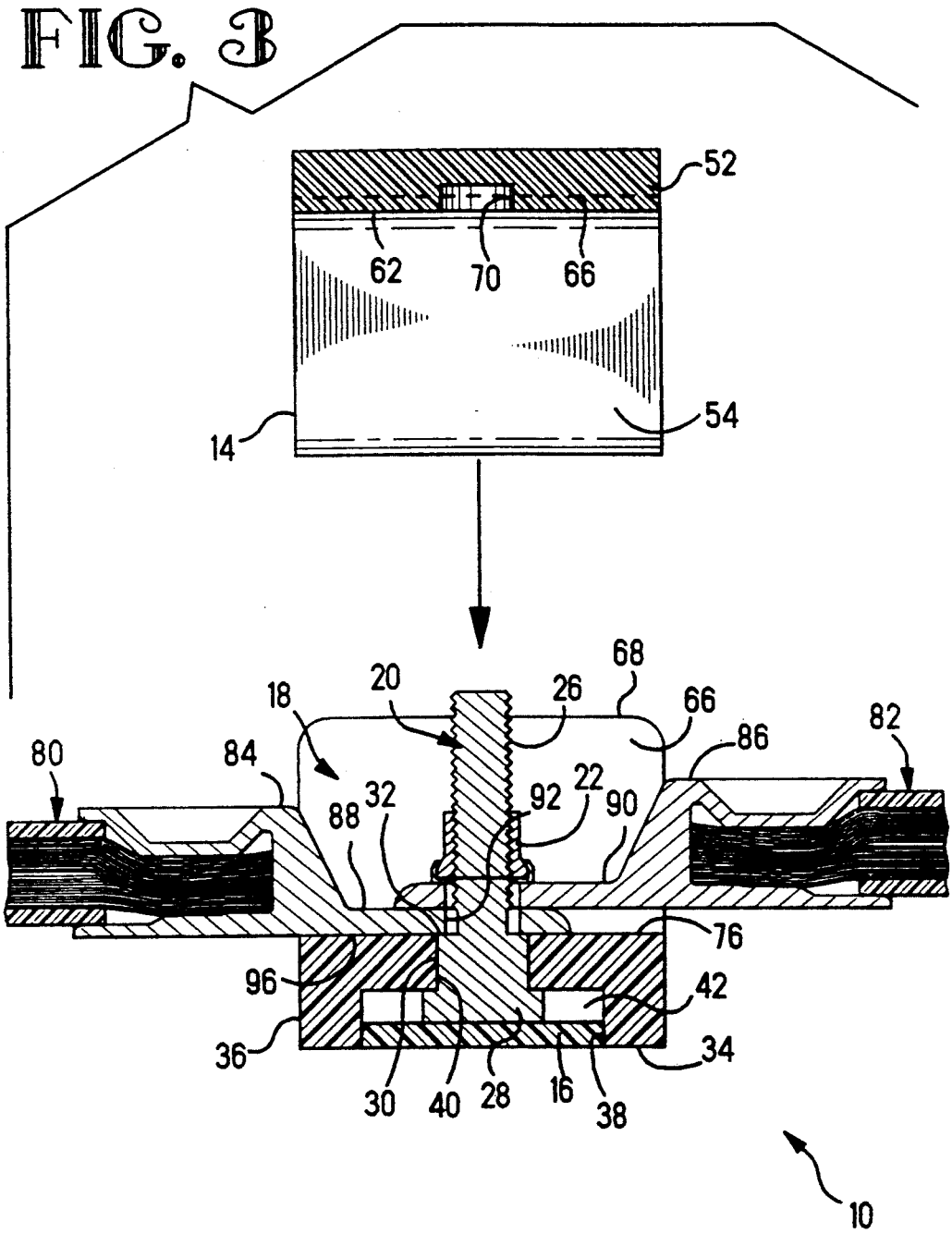

Interconnection of terminals 84,86 is illustrated in FIGS. 2 and 3. Contact sections 88,90 are placed onto threaded post shank 26 and are pressed together against or at least toward upwardly facing surface portion 76 of transverse section 36 of body member 12, by threading of nut assembly 22 onto threaded shank 26. Lower surface 96 of lowermost contact section 88 is disposed along top surface portion 76 and upon being torqued downwardly by nut 22 under a force of about fourteen foot-pounds, engages annular compression surface 32 of large diameter shank portion 30 of post 20. Annular compression surface 32 may be flush with upwardly facing surface portion 76 or extend slightly thereabove, or may preferably be initially incrementally recessed below as shown, with a slight compression of somewhat resilient body member 36 occurring without damage adjacent hole 40, until lower surface 96 of contact section 88 engages compression surface 32. Such torque force establishes an assured gas-tight connection between contact sections 88,90 of terminals 84,86 necessary for transmission of power at levels of for example about 360 amperes. Slight compression of lower surface 96 of contact section 88 against and along top surface portion 76 of body member 12 enhances resistance to vibration.

For resistance to the high temperatures, body member 12 and covers 14 and 16 are preferably molded of polybenzimidazole resin, such as CELAZOLE U-60 sold by Hoechst Celanese Corp. of Houston, Tex. which is engineering plastic of high cost and which must be cast in block form and machined to shape, as it is not moldable in conventional molding apparatus as are other conventional electrical connector housings. Terminal posts 20 are preferably made of high temperature stainless steel alloy such as No. A-286, and nut assemblies may be high tensile of heat treated alloy steel nuts with carbon steel washers such as are sold by Harvard Industries of Union, N.J. under Part No. LH8099-064. Terminals 84,86 are commercially available and may be for example 0–3 or 0–4 gage COPALUM terminals sold by AMP Incorporated, Harrisburg, Pa.

Variations and modifications may occur to result in similar embodiments to the specific one shown, which are within the spirit of the invention and the scope of the claims.

What is claimed is:

1. An electrical connector for the interconnection of pairs of terminated power cables having terminals including ring-tongue contact sections, comprising:

a dielectric body member, at least one terminal bolt, a threaded clamping member associated with each said terminal bolt, and a top cover and a bottom cover of dielectric material;

each said terminal bolt including a threaded shank of known length and diameter extending to a leading end from a body portion having a planar head;

said dielectric body member including a transverse body portion having at least one connection site therealong defined by a bolt-receiving aperture extending from a mounting face to a termination face, each bolt-receiving aperture including a recess along said mounting face for receipt thereinto of a respective said bolt head, and said transverse body portion further including a cover-receiving channel extending thereacross intersecting each said recess for receipt thereinto of said bottom cover for retaining each said at least one terminal bolt in said body member and covering said bolt head thereof;

said body portion of each said terminal bolt having a diameter larger than said shank diameter and defining a forwardly facing annular compression shoulder, and each said bolt head having a dimension larger than said diameter of said body portion, said diameter of a corresponding said bolt-receiving aperture having a diameter corresponding to said body portion diameter;

said bolt head having a thickness corresponding to a selected depth of a respective said recess and having a selected cross-sectional shape and dimension, each said recess having a cross-sectional shape and dimension corresponding closely to said selected dimension and shape of a respective said bolt head and said selected shape being at least asymmetric whereby said bolt head is secured against rotation when disposed within a said recess upon assembly;

said body portion further having an axial dimension approximately equal to said said selected axial length of said bolt-receiving aperture, whereby when said terminal bolt is assembled to said body member with said bolt head disposed in a respective said recess, said annular stop shoulder is disposed approximately flush with said termination face of said body member, whereby when a pair of contact sections of terminals terminating a pair of cables are placed onto a respective said threaded shank of a said terminal bolt and said clamping member is threaded onto said threaded shank and requisite substantial torque is applied to establish an assured electrical connection therebetween when pressed against said termination face of said body member, a bottom one of said contact sections engages and is compressed against said compression shoulder of said terminal bolt with no more than minimal compressive force being received by said termination face of said body member.

2. The electrical connector as set forth in claim 1 wherein said bottom surface of said body member surrounding said channel is coplanar, and said bottom cover is dimensioned to be secured to said bottom surface entirely within said channel to enable mounting of said body member to a planar surface with said bottom surface in full abutment therewith.

3. The electrical connector as set forth in claim 1 wherein said compression surface of each said terminal bolt is disposed at least flush with said termination face of said transverse section.

4. The electrical connector as set forth in claim 1 wherein said compression surface of each said terminal bolt is disposed incrementally recessed with respect to said termination face, whereby a said contact section of a lower one of said pair of said terminals initially engages and abuts said termination face and incrementally compresses said body member until abutting said compression surface upon full torqueing by said clamping member, enhancing resistance to vibration.

5. The electrical connector as set forth in claim 1 wherein said top cover and said bottom cover are securable to said body member by fasteners, said body member is securable to a planar surface by fasteners, and said body member, said top cover, said bottom cover, each said terminal bolt, each said clamping member and each said fastener comprise materials adapted to endure in-service temperatures exceeding 500° F.

6. The electrical connector as set forth in claim 1 wherein said top cover is mountable to said terminating face of said body member with fasteners extending through mounting holes through transverse end flanges of said top cover opposed from corresponding mounting holes through ends of said transverse section of said body member, and said top cover includes a transverse body section between vertical sections extending from said end flanges, said vertical sections having a height selected to correspond to said length of said threaded shank of said at least one terminal bolt.

7. The electrical connector as set forth in claim 6 wherein said transverse body section includes a recess into an inner surface opposed from a respective terminal bolt at a said connection site adapted to receive thereinto an end of said threaded shank of said terminal bolt.

8. The electrical connector as set forth in claim 1 wherein said body member includes a plurality of connection sites, and said body member includes a barrier wall section extending to an leading edge orthogonally outwardly from said termination face of said transverse section medially between adjacent ones of said connection sites.

9. The electrical connector as set forth in claim 8 wherein said top cover is mountable to said terminating face of said body member with fasteners extending through mounting holes through transverse end flanges of said top cover opposed from corresponding mounting holes through ends of said transverse section of said body member, said top cover includes a transverse body section between vertical sections extending from said end flanges, said vertical sections having a height selected to correspond to said length of said threaded shank of said at least one terminal bolt, said transverse body section includes a recess into an inner surface opposed from each said terminal bolt at a said connection site adapted to receive thereinto an end of said threaded shank of said terminal bolt, and said transverse body section further includes grooves into said inner surface opposed from each said barrier wall adapted to receive thereinto said leading edge thereof upon mounting of said top cover to said body member.

10. The electrical connector as set forth in claim 9 wherein said body member includes a polarizing embossment extending outwardly from said termination face thereof at a selected end thereof, and said top cover includes a corresponding embossment-receiving opening at a corresponding said end flange thereof permitting mounting of said top cover to said body member only when positioned in a selected polarized orientation.

* * * * *